US007458325B1

(12) United States Patent
Hopper et al.

(10) Patent No.: US 7,458,325 B1
(45) Date of Patent: Dec. 2, 2008

(54) PROCESS AND APPARATUS FOR THERMALLY TREATING BIO-SOLIDS

(75) Inventors: Daniel C. Hopper, California City, CA (US); Trudy J. Hopper, California City, CA (US)

(73) Assignee: Bio-Solids Remediation Corp., Tehachapi, CA (US)

( * ) Notice: Subject to any disclaimer, the term of this patent is extended or adjusted under 35 U.S.C. 154(b) by 415 days.

(21) Appl. No.: 11/272,803

(22) Filed: Nov. 15, 2005

(51) Int. Cl.
*F23B 7/00* (2006.01)

(52) U.S. Cl. ..... 110/341; 110/226; 34/128; 34/129; 34/180; 34/169; 34/132

(58) Field of Classification Search ..... 34/179–183, 34/165–169, 62–66, 377–379, 504, 505, 34/77, 78, 347, 132; 110/341, 224, 226, 110/216, 217
See application file for complete search history.

(56) References Cited

U.S. PATENT DOCUMENTS 1,994,343 A * 3/1935 Graves ..... 99/471
2,861,423 A * 11/1958 Jerie et al.
3,025,611 A * 3/1962 Preeman ..... 34/137
3,641,683 A * 2/1972 Preeman ..... 34/132
3,848,548 A * 11/1974 Bolejack, Jr. et al.
4,175,335 A * 11/1979 Avril ..... 34/128
4,177,575 A * 12/1979 Brooks ..... 34/392
4,202,282 A * 5/1980 Hobbs et al.
4,307,520 A * 12/1981 Lutz ..... 34/108
4,330,411 A * 5/1982 Florin et al.
4,346,661 A * 8/1982 Nakamura
5,170,726 A * 12/1992 Brashears et al. ..... 110/236
5,195,887 A * 3/1993 Peterson et al.
5,207,176 A * 5/1993 Morhard et al.
RE35,219 E * 4/1996 Kent
RE35,251 E * 5/1996 van den Broek
5,814,234 A * 9/1998 Bower et al.
5,938,433 A * 8/1999 Stimson et al.
5,957,064 A * 9/1999 Barry et al.
5,997,288 A * 12/1999 Adams
6,029,588 A * 2/2000 Baudhuin
6,110,361 A * 8/2000 Bower et al.
6,186,081 B1 * 2/2001 Edlinger
6,216,611 B1 * 4/2001 Baudhuin
6,454,824 B1 * 9/2002 Maryamchik et al. ..... 55/434.4
6,887,389 B2 * 5/2005 Judd

* cited by examiner

*Primary Examiner*—Kenneth B Rinehart
(74) *Attorney, Agent, or Firm*—Novak Druce + Quigg, LLP

(57) ABSTRACT

A high throughput process and apparatus for thermal remediation of bio-solids, e.g., bio-sludge from wastewater treatment plants, has a dryer with a high capacity heat source to volatilize and combust the compounds contained in a first lot of bio-solids. The thermally treated bio-solids are discharged and cooled. Hot gases and fines formed are drawn into a second dryer where a second lot of bio-solids are used to cool the hot gases/fines mixture. An exhaust cooling recirculating unit is used to further cool the gas/fines mixture and separate courser fines before entering the bag house. Additional separation of the fines from gases is achieved in a baghouse or other suitable device for separating fine particles from gas.

18 Claims, 5 Drawing Sheets

PROCESS AND APPARATUS FOR THERMALLY TREATING BIO-SOLIDS

FIELD OF THE INVENTION

The present invention relates to a process and apparatus for thermal alteration of bio-solids (e.g., cow manure or bio-sludge from wastewater treatment plants) to convert the bio-solids into alternate sanitized acceptable form for further use.

BACKGROUND OF THE INVENTION

Treatment of bio-solids is a worldwide environmental problem. As opposed to soil or industrial waste, bio-solids are a direct result of human and animal waste excrement, in short waste of biological origin. For example, bio-solids are produced as the remaining product from a waste water treatment plant after waste water processing is complete and the cleaned water is substantially removed. Bio-sludge is an example of a bio-solid. However, bio-sludge is typically a higher moisture version of bio-solids relative to some of the other common bio-solids. Soil, such as soil being process for soil remediation, is not a bio-solid.

U.S. Pat. No. RE 35251 to van den Broek discloses a sewage sludge treatment system in which gaseous discharge from a pelletizing drier used in the treatment of sewage sludge is partially directed back to a combustion chamber that generates an effluent which is fed to the drier. Volumetric requirements of a gas scrubber and an afterburner are reduced to the volume of gaseous discharge not recycled back to the combustion chamber. A concentrated stream of sewage sludge is mixed with a quantity of dehydrated particulate matter and supplied to a rotary pelletizing drier. Fuel and air undergo a combustion process and are mixed with additional air and part of the gaseous discharge in the combustion chamber which generates a hot gaseous effluent that is directed through the drier. The effluent removes moisture from the mixture of concentrated sludge and dehydrated particulate matter to provide dehydrated particulate sludge and the gaseous discharge. Entrained materials are initially separated from the gaseous discharge by cyclone separators. A gas flow proportioning valve is disposed in a duct system interconnecting the cyclone separators, gas scrubber and combustion chamber for directing a portion of the gaseous discharge back to the combustion chamber.

U.S. Pat. No. 5,195,887 to Peterson et al. discloses a process in which contaminated or uncontaminated soil may be fed to a secondary dryer 28 which is heated with exhaust gas from a primary dryer 22. This cools the hot exhaust gas and, if the soil is contaminated, may serve to drive off moisture and VOCs. If the soil discharged from the secondary dryer 28 is still contaminated it may be fed to a primary dryer 22 which is heated by a burner 20. The exhaust gas from the secondary dryer 28 passes through a conduit 41, exhaust fan 42, venturi 44 and conduit 45 into a particulate control chamber 46. Cooling and reduction of velocity of the gas/fines mixture is achieved as the gas fines mixture proceeds over the surfaces 78 and 80 of airfoils 76 in the particulate control chamber 46 ('887, col. 7, lines 31-33). Gases then pass from the particulate control chamber 46 to a baghouse 52. However, this process treats contaminated soil, rather than bio-sludge, and would be unsuitable for treating bio-sludge.

A principal concern for bio-sludge treatment processes is the need for a high throughput capacity to quickly and efficiently treat the huge quantities of bio-sludge generated by a wastewater treatment plant.

SUMMARY OF THE INVENTION

The process and apparatus of the present invention provides a high throughput process and apparatus for thermal alteration of bio-solids to be converted into an alternate acceptable form for further use, as e.g., a fertilizer or a low grade fuel. The apparatus is equipped with a high capacity heat source to alter bio-solids (also known as bio-sludge) introduced into a first dryer. Hot gases and fines formed are drawn into one or more downstream processors where processes bio-solids are dried before being introduced to secondary processing. An environmental exhaust cooling circulation unit is used to cool exhaust heat to acceptable temperature before entering a fine particles collection assembly.

One aspect of the invention is to provide a high capacity, high speed process and apparatus for bio-sludge thermal treatment which regulates heat exchange in a manner to contribute to achieving a high throughput.

Another aspect of the present invention is to provide a process and apparatus for rapidly cooling hot gases and fines generated before being substantially separated and collected, thereby facilitating separation of gases and fines.

Other advantages and features of the process and apparatus of the present invention will be apparent from the following description provided herein.

The present invention has the capability of producing different end products, including but not limited to: fertilizer, aggregate additive, low grade burner fuel, charcoal filter medium or steam to generate electricity. An advantage of the present invention is the capability of producing multiple end products and relatively low cost relative to present methods. Portable plants can be set up on site or remote locations to service facilities in specified areas. The process and apparatus can be tailored for specific materials by selecting particular off-the-shelf items for various parts of the apparatus. For example, cyclone collectors or specific bag house material may be selected for specific temperature ranges and flow rates. Feeders for the dryers may be screw type feeders or a belt feeder or, if the feed is liquid enough, the feeder may be a pump and feeder pipe.

In its process respects, the present invention provides a process for thermally treating bio-solids, comprising the steps of: heating a first lot of bio-solids in a first rotatable container such that organic compounds present therein volatilize and combust and moisture present is driven off the bio-solids to form a first lot of thermally treated bio-solids and a first volume of hot gases and fines; removing the first lot of thermally treated bio-solids from the first container, transporting the first volume of hot gases and fines to a second rotatable container and introducing a second lot of bio-solids to the second rotatable container, and contacting the first volume of hot gases and fines with the second lot of bio-solids, the second lot being in an amount sufficient to simultaneously cool the gases and fines in the first volume to a desired temperature while heating the second lot to form a second lot of thermally treated bio-solids and a second volume of hot gases and fines; separating the hot gases from the fines in the second volume; and removing the second lot of thermally treated bio-solids from the second container. The process typically simultaneously treats the first and second lots of bio-solids in a continuous process.

The process is capable of high throughput. For example, the first lot of bio-solids may be fed to the first rotatable container at a rate of at least 100 tons per hour, e.g., 125 to 500 tons per hour, of bio-solids on a wet basis, and comprises raw bio-solids.

In its preferred apparatus respects the present invention provides an apparatus for thermally treating bio-solids comprising: a first rotatable container for heating a first lot of bio-solids such that organic compounds present therein volatilize and combust and moisture present is driven off the first lot of bio-solids to form a first lot of thermally treated bio-solids and a first volume of hot gases and fines; a first inlet port for feeding the first lot of bio-solids into an upstream portion of the first rotatable container; a second rotatable container for heating a second lot of bio-solids such that organic compounds present therein volatilize and combust and moisture present is driven off the second lot of bio-solids to form a second lot of thermally treated bio-solids and a second volume of hot gases and fines; a burner for heating the upstream portion of the first rotatable container; a first conduit at a downstream portion of the first rotatable container for removing the first lot of thermally treated bio-solids from the first rotatable container, a second conduit at the downstream portion of the first container for transporting the first volume of hot gases and fines to the second rotatable container; a second port for feeding a second lot of bio-solids into an upstream portion of the second rotatable container; a third conduit at a downstream portion of the second rotatable container for removing the second lot of bio-solids thermally treated from the second rotatable container; a fourth conduit at the downstream portion of the second rotatable container for discharging a second volume of hot gases and fines from the second rotatable container; and means for separating the hot gases from the fines in the second volume. The first rotatable container has inner substantially cylindrical sidewalls which are longitudinally aligned with and revolve about a longitudinal axis of the first rotatable container, and a series of flights arranged along the inner walls of the first container for contacting the first lot of bio-solids. The flights arranged on the upstream portion of the first rotatable container inner sidewalls comprise lifters and wherein the flights arranged on the downstream portion of the first rotatable container inner sidewalls comprise rakes, wherein at least a plurality of the lifters have a closed end distal to the burner.

The ratio of rakes to flight can be varied depending upon the moisture content of the bio-solids feedstock. For example, bio-sludge from wastewater treatment plants may have high moisture content which typically leads to having more flights with a closed end distal to the burner in the upstream portion of the first dryer and the upstream portion of the second dryer. In contrast, cow manure, which typically has a lower moisture content than the wastewater treatment plant bio-sludge could have more rakes in the upstream portions of the first and second dryers.

DETAILED DESCRIPTION OF THE INVENTION

Figure 1:
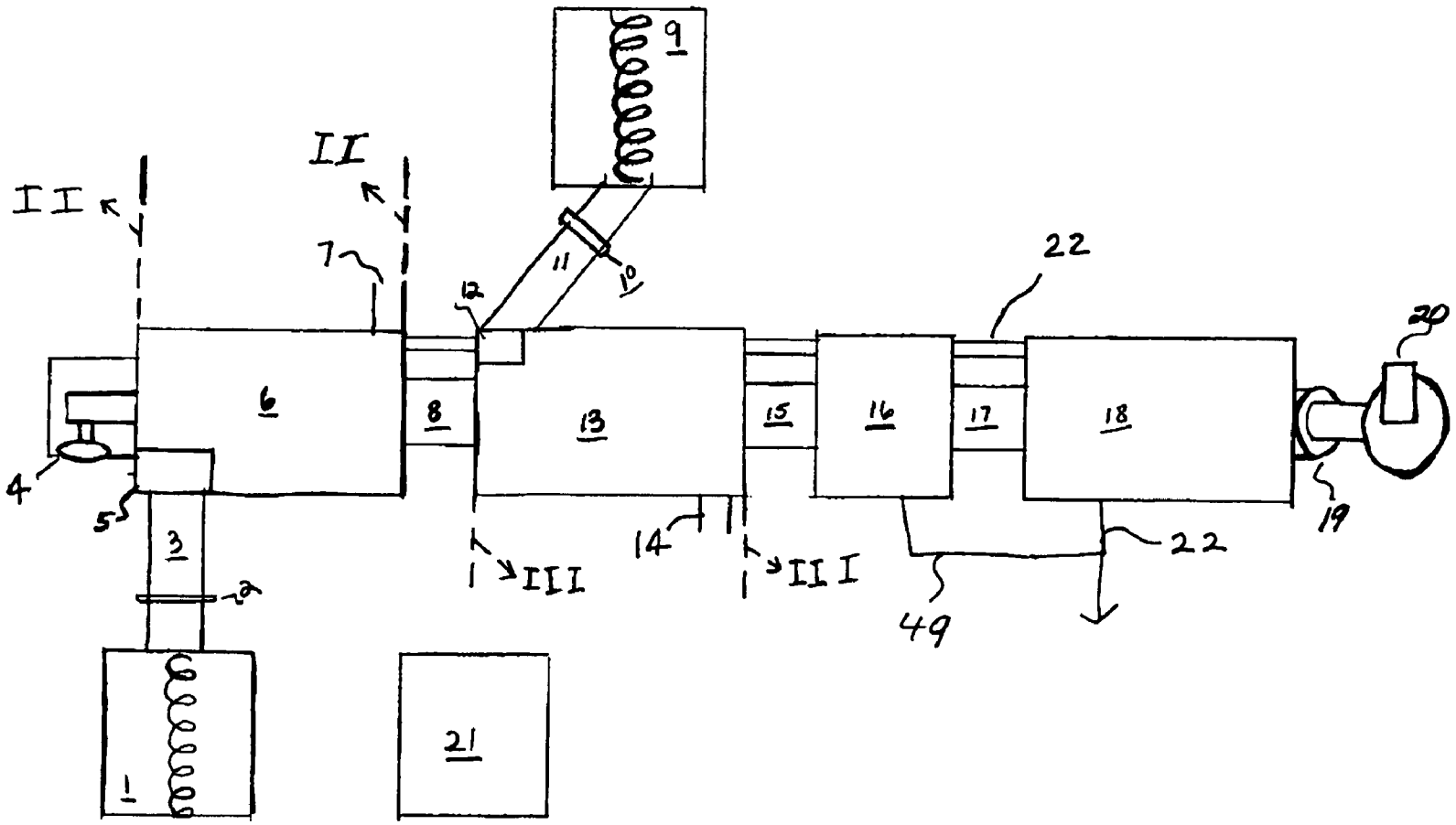
FIG. 1 is a plan view of the treatment apparatus of the present invention illustrating the physical relationship between various elements.

The bio-solids treatment process and apparatus of the present invention are described in connection with FIG. 1.

In the process, bio-solids are introduced into high capacity variable speed feeder bin 1. The capacity of individual feeder bins may vary up to 30 tons or more. The bins are capable of feeding more than one feed either simultaneously or sequentially depending upon the desired processing conditions. The feeder bins may feature speed controls allowing control of the feed rate of a particular bio-solid component and therefore of the distribution of the components within the mixture treated. Then the bio-solid passes across a scalping screen 2 (to eliminate from the sludge pieces larger than a given size for example, about four inch; pieces of this size or larger can not be thermally altered reliably as they are transported through the apparatus) and onto inclined weigh belt 3. Weigh belt 3 allows determination of the weight of the bio-solid components introduced into primary dryer 6 on an instantaneous basis as well as overall. The bio-solids pass from weigh belt 3 into a chute 5 which feeds a first dryer 6. The scalping screen 2 and weigh belt 3 can in some cases be replaced by a screw feeder (not shown) or, if the sludge is sufficiently liquid, a feed tank and pump. The heat source for the first dryer 6 is a burner 4 next to the chute 5. The bio-solid is dried and heated in the first dryer 6 and then discharged out a discharge belt (chute) chute 7 to feed grinders or other units for reducing particle size.

The first dryer 6 is mounted in place and positioned at an incline and allowed to rotate in such a manner that the dryer inlet adjacent to the burner 4 is relatively higher than the outlet at the discharge belt (chute) 7 to assist in the uniform distribution and transport of the mixture along the length of the first dryer 6.

The burner 4 provides the heat for thermal treating the bio-solid by injecting a flame down the center of the dryer. A high power burner 4 may be able to produce a flame delivering 120 million to 200 million BTUs/hour or more, thereby enabling rapid heating of the bio-solid and internal environment of the dryer 6. The burners 4 which may be any suitable burner design. A typical dryer would be 9 feet in diameter by 36 feet in length, available, for example, from Astec Industries, Inc. Chattanooga, Tenn.

The burners 4 are typically able to burn a variety of fuels, for example methane gas. The burners 4 typically are adjustable to permit shaping the flame to be advantageous for the material made in the dryer. The burner 4 may heat the front section (burner end) of the dryer 6 to a temperature in the typical range of 400 to 1800° F. depending upon the product to be produced, moisture content of the feed, or particle size. However, the burner 4 will typically heat to about 1500° F., which allows running the first dryer 6 at a higher tonnage. The bio-material will run through the first dryer 6 parallel with the flames. A typical burner is a star jet burner, but other burners can be used.

The internal mechanism of the first dryer 6 is designed for handling bio-solids and is different from that which would be used in soil remediation. Rotation of the primary dryer 6 permits formation of a uniform mixture of the individual bio-solid components from the feeder bins 1 and facilitates thermal alteration of the bio-solid. Specifically, as the dryer 6 rotates, a series of flights 30 (FIG. 2) within the dryer 6 catch the components passing along the length of the dryer 6. The rotation of the dryer 6 and flights creates a "veil" of the mixture which passes across and through the flame from the burner. The flow of the mixture along the dryer, from the burner to the discharge belt, parallel to the extension of the flame and direction of the flow of exhaust gases is essential to thermally alter the bio-solids.

The thermal treatment of the bio-solids will typically create a small percentage of low molecular weight hydrocarbons. Then the low molecular weight hydrocarbons, which are stripped from the bio-solids will be completely oxidized further, into primarily Carbon Dioxide and Water, at the temperature and time of processing them according to the present invention.

The first dryer 6 is typically a generally cylindrically shaped rotary dryer having generally cylindrical inner walls 25 and an upstream portion 23, an intermediate portion 24 and a downstream portion 27.

Figure 2:
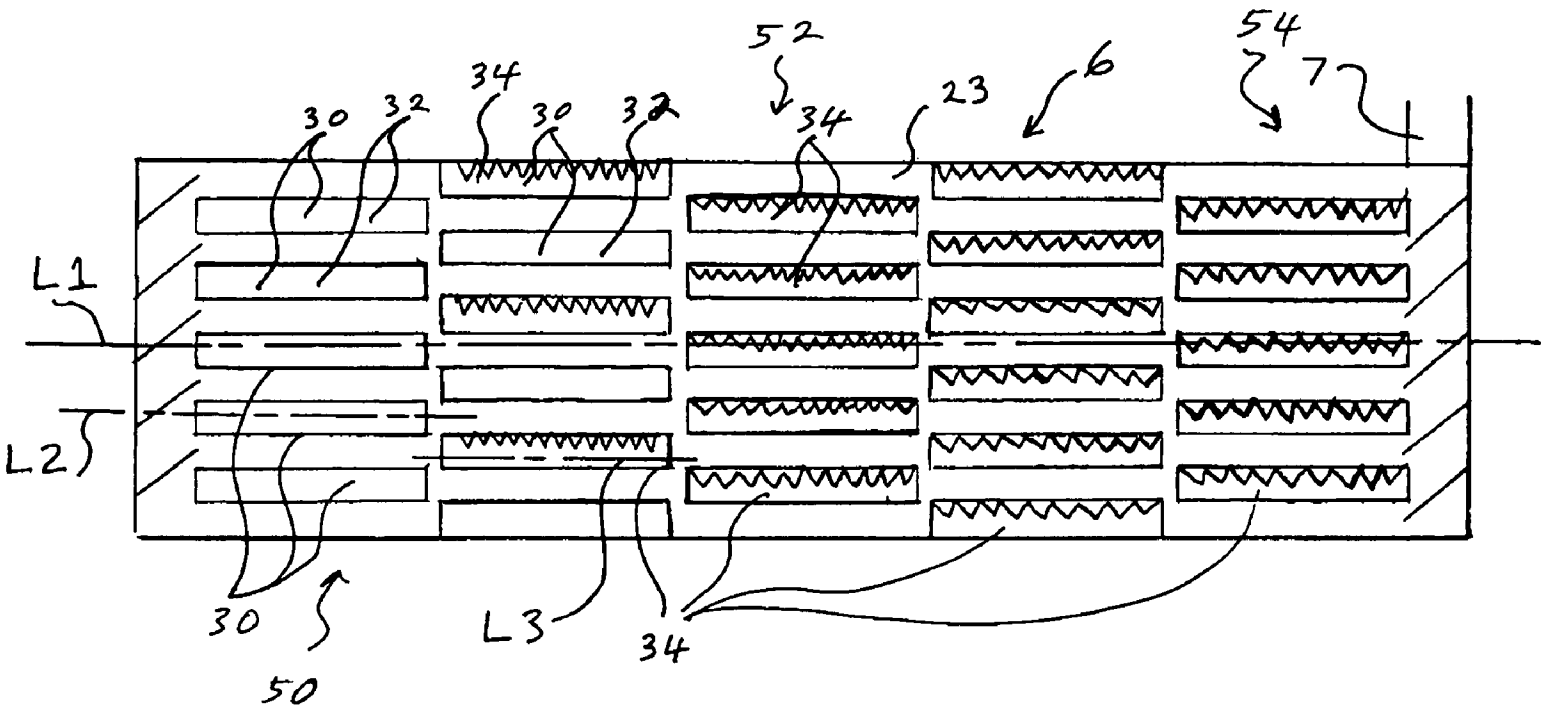
FIG. 2 is a cross section along view II-II showing the interior of the first dryer of FIG. 1.

FIG. 2 shows the interior of the first dryer 6 will have rows of flights. The flights are designed to veil the flame from the introduction of bio-solids into the dryer 6 to the discharge of the thermally altered bio-solid. The flights may be provided as lifters 32 or rakes 34. Flighting varies throughout the length of the dryers to accommodate the transformation of the material. The longitudinal axis L2 of the lifters 32 and the longitudinal axis L3 of the rakes are parallel to the longitudinal axis L1 of the first dryer 6.

The second dryer 13 is typically a generally cylindrically shaped rotary dryer having generally cylindrical inner walls 23 and having an upstream portion 50, an intermediate portion 52 and a downstream portion 54.

Figure 3:
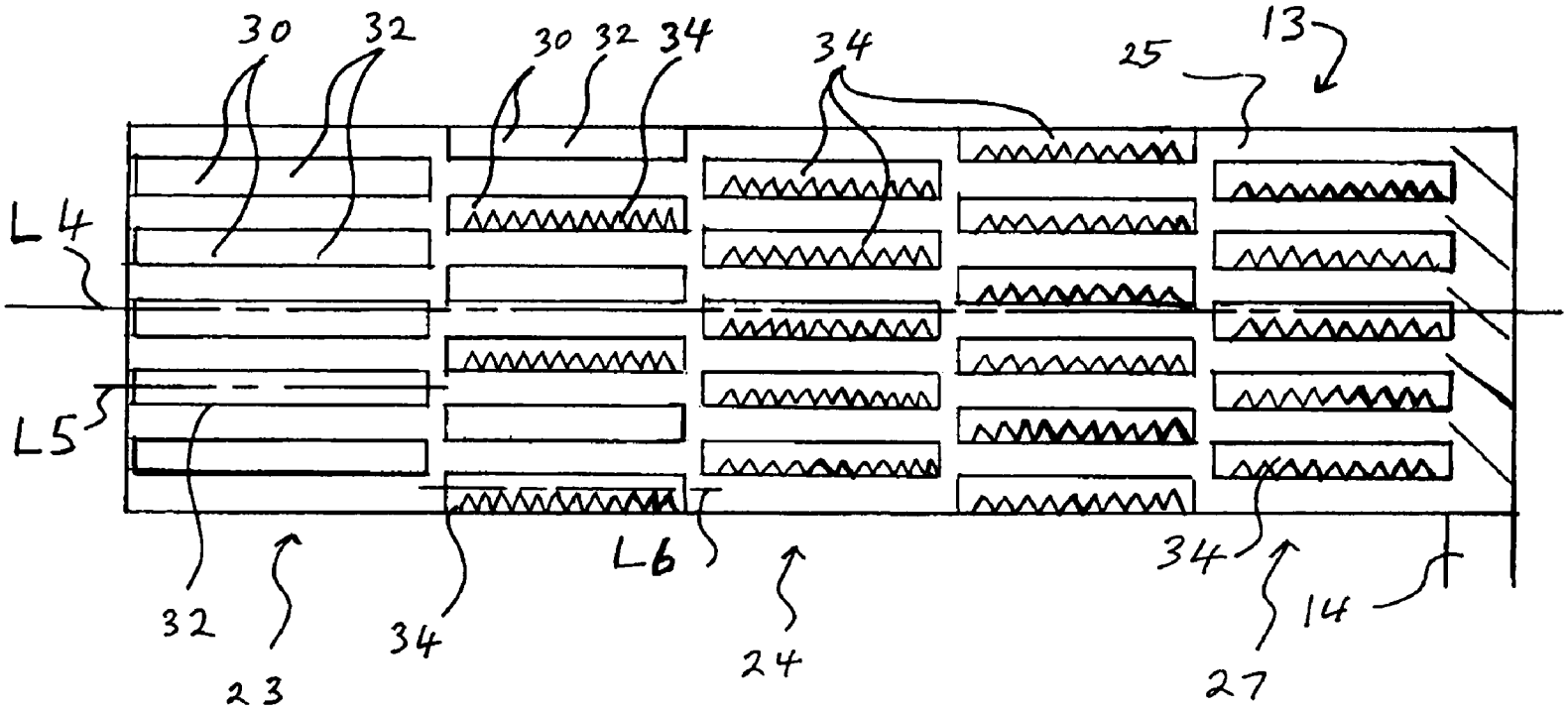
FIG. 3 is a cross section along view III-III showing the interior of the second dryer of FIG. 1.

FIG. 3 shows the interior of the second dryer 13 will have rows of flights. The flights are designed to veil the hot gases with the introduction of bio-solids into the dryer 13 to the discharge of the thermally altered bio-solids. Flighting varies throughout the length of the dryers to accommodate the transformation of the material. The flights for the sludge are custom designed extending the lip to handle the wet solids. The longitudinal axis L5 of the lifters 32 and the longitudinal axis L6 of the rakes are parallel to the longitudinal axis L4 of the second dryer 13.

Figure 4:
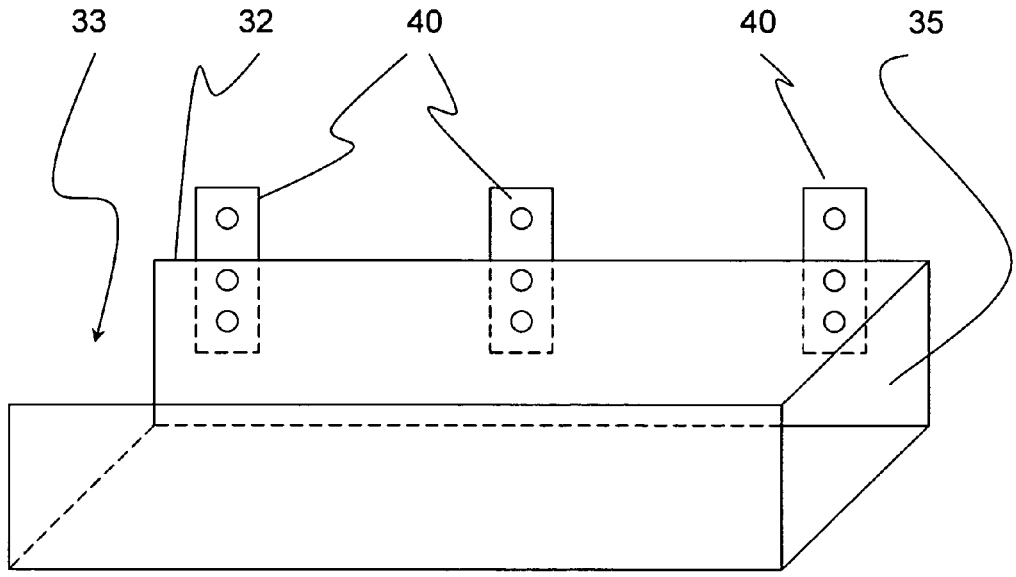
FIG. 4 shows an embodiment of a lifter.

FIG. 4 shows an embodiment of a lifter 32. Typically attachment brackets 40 are attached to the inner walls of the dryer 6, 13 and then the lifter 32 is attached to the brackets 40. The end 35 of the lifter 32 distal to the burner 4 is typically closed off and the end 33 of the lifter 32 proximal to the burner 4 is open. In contrast, prior art flights for soil remediation are off the shelf items with no closed distal wall.

Figure 5:
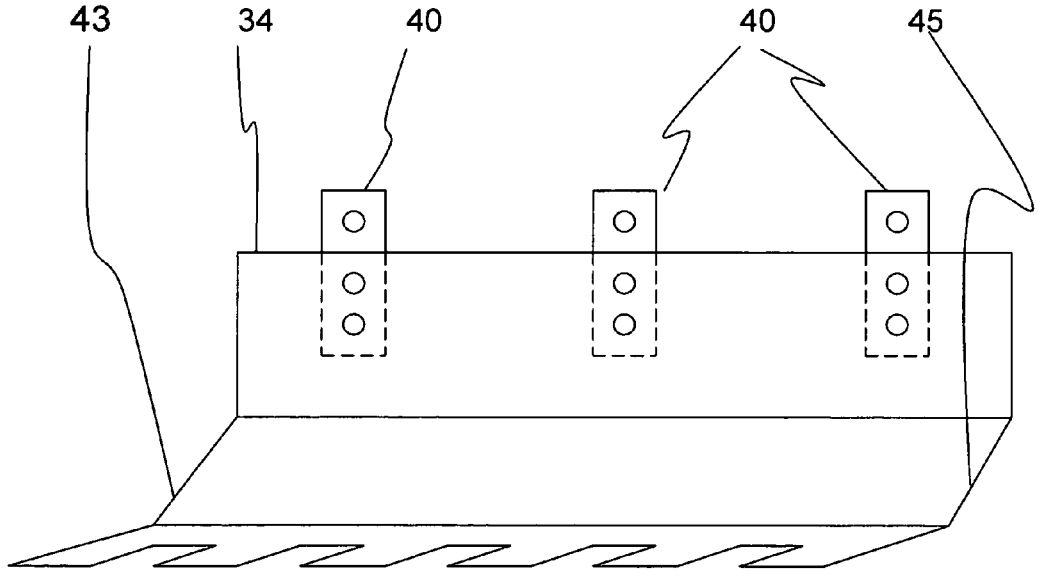
FIG. 5 shows an embodiment of a rake.
Figure 6:
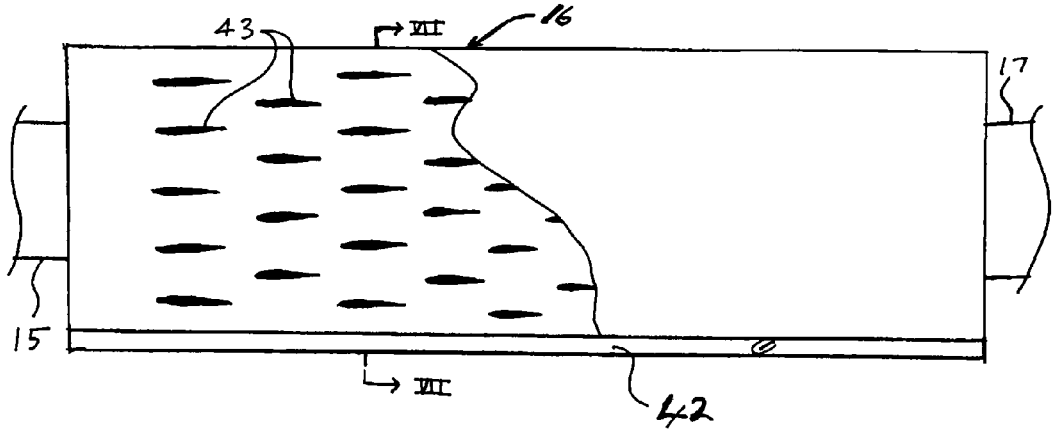
FIG. 6 is a side view of the Environmental Exhaust Cooling Circulation Unit.
Figure 7:
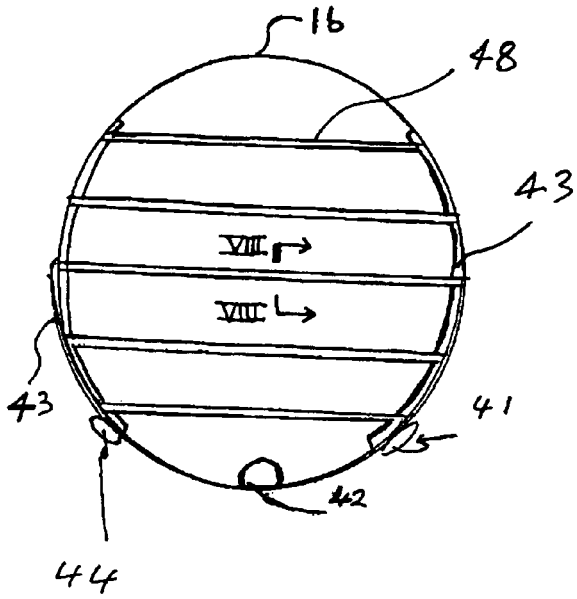
FIG. 7 is a cross-sectional view along line VI-VI of the Environmental Exhaust Cooling Circulation Unit of the present invention as shown in FIG. 2.
Figure 8:
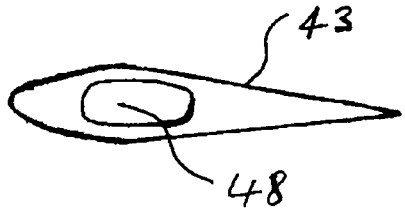
FIG. 8 is an exploded view of the cross-section along line VIII-VIII of one embodiment of an airfoil utilized in the Environmental Exhaust Cooling Circulation Unit as shown in FIG. 7.

FIG. 5 shows an embodiment of a rake 34.

The first row of flights in both dryers 6, 13 will be lifters to veil the flame from the 10:00 to 2:00 position. The second row of flights includes lifters 32 and rakes 34. Then the rest of the rows of flights will include rakes to help break up the sludge. If desired there may be one or more additional rows of lifters between the first and second rows.

The excess heat will then enter the second dryer 13 which is fed with sludge to absorb excess heat and dry the sludge. The flights in the second dryer 13 will be the same as in the first dryer 6. The hot gas discharged from the second dryer 13 discharges into an Environmental exhaust cooling circulation unit 16. The environmental exhaust cooling circulations unit will have airfoil shaped inserts which circulate cooling water or antifreeze. The chamber 16 typically has an auger in case there are small particles. The bag house 18 will collect the fines. If desired a portion of the collected fines may be blended with the first lot of thermally treated bio-solids or the second lot of thermally treated bio-solids.

The temperature is selected according to the product desired. Typically the process and apparatus can make two different products: a clean, inert fertilizer and/or a combustible product suitable for use in coal-fired plants, cement plants, or fill aggregate for asphalt mixes and or concrete.

The process and apparatus can also process cow manure either alone or with the bio-sludge. For example, a mixture of manure and bio-sludge can be sent to the first and second dryers 6, 13 or cow manure can be sent to the second dryer 13 while bio-sludge is sent to the first dryer 6. If desired the cow manure can be processed to remove methane by known processes prior to processing the cow manure in the present process and apparatus. For example, the process you remove the methane gases from the raw cow manure by any conventional method or future method for removal of methane and then process the resulting. The temperature ranges and flighting in the dryers 6, 13 can be adjusted to accommodate the different burning characteristics of different ratios of bio-sludge and cow manure. For example, low moisture easier burning blends may employ a greater ratio of rakes to lifters than a lower moisture more difficult to burn blend.

The typical temperature of the flame of the burner 4 when it burns natural gas is about 1800 to 2000° F. The typical temperature of the outside of the dryer 6 ranges from about 850 to 750° F., e.g. about 800 to 850° F., at the end proximal to the burner 4 and about 550 to 650° F., e.g. about 575 to 625° F., at the end distal to the burner 4.

Typically, the process and apparatus runs raw material through both dryers and heats the material in the first dryer 6 to typically between 200 and 800° F., for example from about 375 to about 600° F., to be used for fertilizer and heats the raw material going through the second dryer 13 to typically between 200 to 800° F., for example from about 375 to about 600° F., to make combustible material. However as further explained below, material recycled from the particular dryer or already processed through the other dryer can be fed to the dryer 6, 13 in addition to or instead of raw material. Mixing of raw material and already processed material is useful to control process conditions in the dryers. Thus the bio-solids typically exit the dryer 6 at about 200 to 450° F., for example about 375 to 450° F. The residence time of the bio-solids in the dryer 6 typically ranges from about 30 seconds to 20 minutes.

Hot gas exits the first dryer 6 and passes through the conduit (duct) 8 to provide heat to the second dryer 13. The exhaust gas from the dryer 6 typically has a temperature in the range from 1100 to 1300° F., e.g., 1200 to 1250° F. The first dryer 6, second dryer 13 and conduit 8 are kept sufficiently large to keep down gas velocity out of the first dryer 6 and through conduit 8 and the second dryer 13. Accordingly, the gas/fines mixture is drawn into the second dryer 13. At the same time, a second lot of bulk media is introduced into the second dryer 13 via weigh belt 11. The second dryer 13 is similar to primary (first) dryer 6 in that it is also rotatably mounted and positioned at an incline sufficient such that its inlet end near the primary dryer is higher than its outlet end. Such an orientation encourages mixing.

The treated material exits the first dryer 6 through a discharge chute 7 which typically feeds a grinder (not shown) to grind the treated material to a desired particle size which is then stored as a final product or is further processed. Typically, this material is useful as fertilizer or low grade fuel depending upon processing conditions.

For example, the ground (still hot) material may go from a storage pile or storage bin (not shown) to a high capacity variable speed feeder bin 9. The capacity of individual feeder bins may vary up to 30 tons or more.

The feeder bin 9 may feature speed controls allowing control of the feed rate of a particular bio-solid component and therefore of the distribution of the components within the mixture treated. For example, the material being fed to second dryer 13 may be a mixture of ground (still hot) bio-solid material already thermally altered in the first dryer 6 together with previously untreated bio-solid. The relative amount of these materials varies depending upon the needs of the plant. For example, if there is a desire to maintain a lower discharge temperature in the second dryer 13, then fresh bio-solid may be directly fed to it to the second dryer. If a very severe thermal alteration of the bio-solid is desired, then a sizable portion of the bio-solid feed to the second dryer 13 may be fresh bio-solid. This at least partially dries the fresh bio-solid. Then the at least partially dried bio-solid may be fed to the first dryer 6 together with additional fresh bio-solid to be subjected to the higher temperatures present in the first dryer 6.

After discharge from the feeder bin 9 the material passes across a scalping screen 11 (to eliminate from the sludge pieces larger than a given size) and up a second weigh belt 10 into a chute 12 to the second dryer 13. The scalping screen 11, weigh belt 10 and dryer 13 can in some cases be replaced by a screw feeder or, if the feed is sufficiently fluid, may be replaced by a pump and a pipe. The second dryer 13 may alter the material to its final state of thermal alteration or may act as a pre-treater such that the solid effluent from the second dryer 13 may be recycled to the second dryer 13 or be sent to the first dryer 6. The solid material exits the dryer 13 along a discharge chute 14. Then if it is final product it may be fed to a processor not shown, cooled with water mist and stockpiled. This material is useful as fertilizer or low grade fuel depending upon processing conditions.

Hot gas exits dryer 13 at about typically between 400 and 800° F. through conduit (duct) 15 and feeds into environmental exhaust cooling circulation unit 16. Gas velocity is controlled to reduce the amount of fines entrained with the gas passing from dryer 6, through duct 8, dryer 13 and duct 15 into the cooler 16. Part of this control is to have dryer 6, through duct 8, and dryer 13 all have about the same inner diameter.

Velocities through the dryers 6, 13 may vary due to a variety of factors: BTUs/hour generated by the burner, pounds of exhaust gas generated in the dryers, steam generated in the dryers, volume of solid or semi-solid material in the dryers, or the dampener system which controls the velocity of air flow from the burner to the exhaust fan.

The composition of the bio-solids may affect the amount of fines generated in the dryers 6, 13. The inventors have discovered the unexpected advantage that processing bio-solids from waste water plants produce low levels of fines. The present inventors theorize that common wastewater treating chemicals, e.g. polymers used as flocculants or coagulants added in wastewater treating plants, assist in binding fines to the thermally altered bio-solids. Some typical wastewater treating chemicals include epi-DMA, polyDADMAC, polyacrylamide, polyacrylate and phosphino-carboxylic acids.

A majority of the fines generated as a result of mixing of material components and combustion in the first dryer 6 are entrained in hot exhaust gas (containing air and combustion gases) discharged from the first dryer 6 through the duct 8 and then passed to the second dryer 13 to provide heat to the second dryer 13 for its above-discussed drying step. The hot gas with fines then passes from the second dryer 13 through the duct 15 and into the environmental exhaust cooling circulations unit 16. The environmental exhaust cooling circulation unit 16 cools the hot gas, by running cooling fluid through airfoils in the environmental exhaust cooling circulation unit 16, to an acceptable temperature for introducing the cooled hot air into a bag house 18. The environmental exhaust cooling circulation unit 16 also removes fines which deposit on the airfoils.

The bag house 18 removes any remaining fines not previously removed by upstream processing. Air discharges from the bag house 18 through an exhaust fan 19. The fines collected in the environmental exhaust cooling circulation unit 16 and the bag house 18 are optionally returned to the first dryer 6.

The second lot of bulk media of a sufficient amount is introduced into the second dryer 13 to cool the gas/fines mixture exhausted from primary dryer 6 to a desired temperature, for example, about 325° F., to facilitate separation. Simultaneously, the bulk media so introduced is preheated with the heat from the hot gas/fines mixture in the second dryer and discharged at belt 14.

At the outlet of the second dryer 13, the fines and gases produced form a second gas/fines mixture. This gas/fines mixture is drawn from secondary dryer 13 into conduit 15 then passes through Environmental exhaust cooling circulation unit 16 into conduit 17 entering into the dust collector (baghouse) 18 which will collect all or substantially all of the remaining fines and optionally auger the collected fines back to the dryer 6. Then the air will be dispersed out the exhaust fan 19 and then out stack 20. The baghouse is typically provided with a dampener (not shown) on the exhaust end of the bag house 18 as an integral part of the baghouse/exhaust fan assembly. The damper regulates the velocity of the air flow. Under some combination operating material and conditions, an afterburner will be incorporated (not shown) off shelf item.

Referring now to FIGS. 2-4, the particular means for achieving the reduction in velocity and separation of the gas/fines mixture through the environmental exhaust cooling recirculation unit 16 are illustrated.

FIG. 2 illustrates a preferred detailed description of the environmental exhaust cooling re-circulating unit (EECRU) 16, a cylindrical chamber horizontally mounted with a fines return conduit 22 which carries fines to the baghouse 18 fines return system 22 and henceforth to dryer 6. A net work of piping 41 and 42 furnish cooling agent in a particular embodiment within the EECRU unit along it's (length typically 40'× 12'×14' dia) is mounted. A series of hollow airfoils aligned and staggered configuration across the inside dia of the EECRU 16. A suitable airfoil shape is illustrated in FIG. 4 but not limited to the configuration.

FIG. 2 also illustrates a pattern of staggered airfoils 43. The placement (staggering and number of airfoils) will be determined by the demands of material at the plant location. The objective is to create and maintain smooth flow throughout the cross section and length of the EECRU unit 16. Any modification to accomplish this will be considered to be within the scope of this invention.

Velocity reduction and cooling of hot gases/fines are accomplished as gases/fines flow over the external surfaces of the airfoils 43. The airfoils 43 are fabricated to allow a cooling agent to flow through the interior walls of airfoil via interior wall conduits attached to airfoils 43, coolant such as water or antifreeze solution. Thus, as shown in FIG. 3, cooling agent passes into the EECRU through inlet 41, then through an number of interior wall inlet conduits 43 to channels 48 (FIG. 4) within the airfoils and then through others of the conduits 43 to discharge through outlet 44.

Fines collected are collected at the bottom of EECRU unit 16 by a screw feed 42 which discharges as a fines stream 49 and is typically mixed with fines in the baghouse return system 22 for either disposal, return to the first dryer 6 or other suitable processing.

Cooled gases/fines from EECRU unit 16 pass through duct 17 into baghouse 18 where fines are further separated from gasses. Fines collected are returned to dryer 6 via return 22 for further thermal treatment as fines are a light molecular weight. A portion of the clean fines are discharged with the bio-solids chute 7. Gases free of fines are discharged from baghouse 18 via dampener/exhaust fan assembly 19 into exhaust stack 20 which may feature an after burner if VOC'S warrant.

The capability exist for additional control of the process as required by the advancement of new computerized monitoring process are developed to provide for optimized site conditions. At least a portion of the controls may be provided in a control house 21, if desired.

EXAMPLE

Bio-sludge was processed in a single stage rotary dryer provided with flights. Heat was provided to the rotary dryer by a burner using natural gas fuel. The rotary dryer had a first row of flights proximal to the burner and a second row of flights distal to the burner. The first row of flights had a design in which the end distal to the burner of each of the flights in the first row was closed. The second row of flights was all rakes.

Five (5) pounds of the bio-sludge was substantially continuously fed slowly to the dryer at a rate of about 4 cups per every ten (10) minutes. The residence time of the bio-solids in the dryer was about 1 minute and 45 seconds. The outside surface of the dryer had a temperature of about 800 to 850° F. at the end proximal to the burner and a temperature of about 600° F. at the end distal to the burner. The finished product had a temperature of about 400° F. The exhaust gas from the dryer had a temperature of about 1200-1250° F. The burner flame temperature was about 1800 to 2000° F.

The bio-sludge fed to the dryer had a composition as shown in Table 1. The thermally altered product had a composition as shown in Table 2.

TABLE 1

Bio-sludge Composition

| Constituent | Measurement | Units | PQL | Method |
|---|---|---|---|---|
| Antimony | <PQL | mg/kg | 5 | SW-6010 |
| Arsenic | 6.4 | mg/kg | 0.5 | SW-6010 |
| Barium | 170 | mg/kg | 0.5 | SW-6010 |
| Beryllium | <PQL | mg/kg | 0.5 | SW-6010 |
| Cadmium | <PQL | mg/kg | 0.5 | SW-6010 |
| Chromium | 57 | mg/kg | 0.5 | SW-6010 |
| Cobalt | <PQL | mg/kg | 2.5 | SW-6010 |
| Copper | 220 | mg/kg | 1 | SW-6010 |
| Lead | 6.3 | mg/kg | 2.5 | SW-6010 |
| Mercury | 1.4 | mg/kg | 0.2 | SW-7471 |
| Molybdenum | 43 | mg/kg | 2.5 | SW-6010 |
| Nickel | 13 | mg/kg | 0.5 | SW-6010 |
| Selenium | 5.8 | mg/kg | 0.5 | SW-6010 |
| Silver | 6.4 | mg/kg | 0.5 | SW-6010 |
| Thallium | <PQL | mg/kg | 5 | SW-6010 |
| Vanadium | 24 | mg/kg | 0.5 | SW-6010 |
| Zinc | 350 | mg/kg | 2.5 | SW-6010 |
| pH (1:1) | 6.77 | pH Units | — | SW-9040 |
| Nitrate as N | 1.2 | mg/kg | 1 | EPA-300.0 |
| Nitrite as NO2 | <PQL | mg/kg | 0.65 | EPA-353.2 |
| Total Kjeldahl Nitrogen | 60000 | mg/kg | 4000 | EPA-351.2 |
| Ammonia as N | 5000 | mg/kg | 200 | EPA-350.1 |
| Total Phosphorous | 13000 | mg/kg | 1000 | EPA-365.4 |
| Solids | 90.03 | % | 0.05 | Calculated |
| Modified Wet Test (STLC) Hexavalent Chromium | <PQL | mg/L | 0.2 | SW-7198 |
| Modified Wet Test (STLC) Total Dissolved Solids | 3400 | mg/L | 200 | EPA-160.1 |

PQL means practical quantitation limit. Thus, in Table 1, <PQL means below detection limits.

TABLE 2

Thermally Altered Bio-sludge Composition

| Constituent | Measurement | Units | PQL | Prep Method | Test Method |
|---|---|---|---|---|---|
| Antimony | ND | mg/kg | 100 | EPA 3050B | EPA 6020B |
| Arsenic | ND | mg/kg | 10.0 | EPA 3050B | EPA 6020B |
| Barium | 455 | mg/kg | 10.0 | EPA 3050B | EPA 6020B |
| Beryllium | ND | mg/kg | 10.0 | EPA 3050B | EPA 6020B |
| Cadmium | ND | mg/kg | 10.0 | EPA 3050B | EPA 6020B |
| Chromium | 152 | mg/kg | 50.0 | EPA 3050B | EPA 6020B |
| Cobalt | ND | mg/kg | 10.0 | EPA 3050B | EPA 6020B |
| Copper | 490 | mg/kg | 50.0 | EPA 3050B | EPA 6020B |
| Lead | 21.6 | mg/kg | 10.0 | EPA 3050B | EPA 6020B |
| Mercury | 0.157 | mg/kg | 0.100 | EPA 7471A | EPA 7471A |
| Molybdenum | 101 | mg/kg | 50.0 | EPA 3050B | EPA 6020B |
| Nickel | ND | mg/kg | 50.0 | EPA 3050B | EPA 6020B |
| Selenium | 35.4 | mg/kg | 10.0 | EPA 3050B | EPA 6020B |
| Silver | ND | mg/kg | 50.0 | EPA 3050B | EPA 6020B |
| Thallium | ND | mg/kg | 10.0 | EPA 3050B | EPA 6020B |
| Vanadium | ND | mg/kg | 50.0 | EPA 3050B | EPA 6020B |
| Zinc | 1890 | mg/kg | 50.0 | EPA 3050B | EPA 6020B |
| pH (1:1) | 8.42 | pH Units | 0.100 | EPA 9045C | EPA 9045C |
| Nitrate as N | 24.8 | mg/kg | 5.00 | EPA 300 | EPA 300 |
| Nitrite as N | ND | mg/L dry | 0.0101 | EPA 300 | EPA 300.0 |
| Total Kjeldahl Nitrogen | 1650 | mg/kg | 0.260 | EPA 351.2 | EPA 351.3M |

TABLE 2-continued

Thermally Altered Bio-sludge Composition

| Constituent | Measurement | Units | PQL | Prep Method | Test Method |
|---|---|---|---|---|---|
| Ammonia as N | 263 | mg/kg | 0.0500 | EPA 350.2 | EPA 350.2M |
| Total Phosphorous | 13400 | mg/kg | 0.600 | EPA 365.2 | EPA 365.2M |
| Solids | 99.4 | % | 0.100 | NO PREP | % Calculation |
| Modified Wet Test (STLC) Hexavalent Chromium | ND | mg/L | 0.0100 | DI-STLC | EPA 7196A |
| Total Dissolved Solids | 1290 | mg/L | 1.00 | DI-STLC | EPA 160.1 |

In Table 2 "ND" means not detected.

Embodiments other than those expressly described above come within the spirit and scope of the present invention. Thus, the invention is not limited by the above description but rather is defined by the claims appended hereto.

What is claimed is:

1. A process for thermally treating bio-solids, comprising the steps of:

heating a first lot of bio-solids in a first rotatable container such that organic compounds present therein volatilize and combust and moisture present is driven off the first lot of bio-solids to form a first lot of thermally treated bio-solids and a first volume of hot gases and fines;

removing the first lot of thermally treated bio-solids from the first container, transporting the first volume of hot gases and fines to a second rotatable container and introducing a second lot of bio-solids to the second rotatable container, and contacting the first volume of hot gases and fines with the second lot of bio-solids in the second rotatable container, the second lot being in an amount sufficient to simultaneously cool the gases and fines in the first volume to a desired temperature while heating the second lot of bio-solids such that organic compounds present therein volatilize and combust and moisture present is driven off the second lot of bio-solids to form a second lot of thermally treated bio-solids and a second volume of hot gases and fines;

separating the hot gases from the fines in the second volume; and removing the second lot of thermally treated bio-solids from the second rotatable container.

2. The process of claim 1, wherein the first rotatable container has inner substantially cylindrical sidewalls which are longitudinally aligned with and revolve about a longitudinal axis of the first rotatable container, wherein in the first container the bio-solids contact a series of flights arranged along the inner walls.

3. The process of claim 2, wherein the first container inner walls have an upstream portion proximal to a burner and a downstream portion distal to a burner, wherein the flights arranged on the upstream portion of the first container inner sidewalls comprise lifters and wherein the flights arranged on the downstream portion of the first container inner sidewalls comprise rakes, wherein at least a plurality of the lifters have a closed end distal to the burner.

4. The process of claim 3, wherein the first rotatable container inner walls have an intermediate portion between the upstream portion and the downstream portion, wherein the flights arranged on the intermediate portion of the first rotatable container inner sidewalls comprise lifters and rakes.

5. The process of claim 1, wherein the second container has inner substantially cylindrical sidewalls which are longitudinally aligned with and revolve about a longitudinal axis of the second container, wherein in the second container the bio-solids contact a series of flights arranged along the inner walls.

6. The process of claim 5, wherein the second container inner walls have an upstream portion and a downstream portion, wherein the flights arranged on the upstream portion of the second container inner sidewalls comprise lifters and wherein the flights arranged on the downstream portion of the second container inner sidewalls comprise rakes, wherein at least a plurality of the lifters have a closed end distal to the upstream end of the second rotatable container.

7. The process of claim 6, wherein the second container inner walls have an intermediate portion between the upstream portion and the downstream portion, wherein the flights arranged on the intermediate portion of the second container inner sidewalls comprise lifters and rakes.

8. The process of claim 1, wherein the first container has inner substantially cylindrical sidewalls which are longitudinally aligned with and revolve about a longitudinal axis of the first container, wherein a flame is discharged into the first container and the first container has rows of flights, wherein a first row of the flights most proximal to an upstream end of the first container has flights comprising lifters to veil the flame from about the 10:00 to about the 2:00 position, and another row of flights, downstream of the first row of flights, including lifters and rakes, and the remainder of the rows of flights downstream of the another row of flights comprises rakes to break up the bio-solids, wherein at least a plurality of the lifters have a closed end distal to the burner.

9. The process according to claim 1, wherein the first lot of bio-solids comprises raw bio-solids.

10. The process according to claim 1, wherein the first lot of bio-solids comprises thermally treated bio-solids previously removed from the first or second container.

11. The process according to claim 1, wherein the second lot of bio-solids comprises raw bio-solids.

12. The process according to claim 1, wherein the second lot of bio-solids comprises thermally treated bio-solids previously removed from the first or second container.

13. The process according to claim 1, wherein the first lot of bio-solids is fed to the first container at a rate of at least 125 tons per hour of bio-solids on a wet basis, and comprises raw bio-solids.

14. The process of claim 1, further comprising blending a portion of the fines from the second volume with the first lot of thermally treated bio-solids.

15. The process of claim 1, further comprising blending a portion of the fines from the second volume with the second lot of thermally treated bio-solids.

16. The process of claim 1, wherein the first container comprises a first rotatably supported dryer and the second container comprises a second rotatably supported dryer.

17. The process of claim 16, wherein the first lot of bio-solids passes from a first set of feeder bins into the first rotatably supported dryer and the second lot of bio-solids passes from a second set of feeder bins to the second rotatably supported dryer.

18. A process according to claim 16, wherein a burner is provided at an upstream end of the first dryer and heats the first dryer, wherein the first lot of bio-solids is introduced into the upstream end of the first dryer.

* * * * *